US008058223B2

(12) United States Patent
Bernhardt et al.

(10) Patent No.: US 8,058,223 B2
(45) **Date of Patent: *Nov. 15, 2011**

(54) AUTOMATIC OR MACHINE DISHWASHING COMPOSITIONS OF SULFONATED ESTOLIDES AND OTHER DERIVATIVES OF FATTY ACIDS AND USES THEREOF

(75) Inventors: Randal J. Bernhardt, Antioch, IL (US); Lourdes R. Alonso, Deerfield, IL (US); Gregory P. Dado, Chicago, IL (US); Ronald A. Masters, Glenview, IL (US)

(73) Assignee: Stepan Company, Northfield, IL (US)

( * ) Notice: Subject to any disclaimer, the term of this patent is extended or adjusted under 35 U.S.C. 154(b) by 203 days.

This patent is subject to a terminal disclaimer.

(21) Appl. No.: 12/507,018

(22) Filed: Jul. 21, 2009

(65) Prior Publication Data

US 2010/0184632 A1 Jul. 22, 2010

Related U.S. Application Data

(63) Continuation-in-part of application No. PCT/US2009/031608, filed on Jan. 21, 2009.

(51) Int. Cl.
*C11D 1/28* (2006.01)

(52) U.S. Cl. ..... 510/495; 554/96

(58) Field of Classification Search ..... 510/495; 554/96

See application file for complete search history.

(56) References Cited

U.S. PATENT DOCUMENTS

| | | | |
|---|---|---|---|
| 2,581,375 | A | 1/1952 | De Groote et al. |
| 2,743,288 | A | 4/1956 | Rueggeberg et al. |
| 2,995,524 | A | 8/1961 | Wylie et al. |
| 3,332,880 | A | 7/1967 | Kessler et al. |
| 3,377,290 | A | 4/1968 | Werner et al. |
| 3,664,961 | A | 5/1972 | Norris |
| 3,668,153 | A | 6/1972 | Crotty |
| 3,898,187 | A | 8/1975 | Miller |
| 3,929,678 | A | 12/1975 | Laughlin et al. |
| 4,228,044 | A | 10/1980 | Cambre |
| 4,435,307 | A | 3/1984 | Barbesgaard et al. |
| 4,438,025 | A | 3/1984 | Satsuki et al. |
| 4,507,219 | A | 3/1985 | Hughes |
| 4,548,744 | A | 10/1985 | Connor |
| 4,561,998 | A | 12/1985 | Wertz et al. |
| 4,597,898 | A | 7/1986 | Vander Meer |
| 4,663,071 | A | 5/1987 | Bush et al. |
| 4,816,188 | A | 3/1989 | Kitano et al. |
| 4,936,551 | A | 6/1990 | Behler et al. |
| 5,002,683 | A | 3/1991 | Behler et al. |
| 5,071,594 | A | 12/1991 | Borland et al. |
| 5,075,501 | A | 12/1991 | Borland et al. |
| 5,294,726 | A | 3/1994 | Behler et al. |
| 5,329,030 | A | 7/1994 | Schenker et al. |
| 5,429,684 | A | 7/1995 | Osberghaus et al. |
| 5,441,156 | A | 8/1995 | Fabry et al. |
| 5,466,394 | A | 11/1995 | de Buzzaccarini et al. |
| 5,576,282 | A | 11/1996 | Miracle et al. |
| 5,622,925 | A | 4/1997 | de Buzzaccarini et al. |
| 5,679,630 | A | 10/1997 | Baeck et al. |
| 5,776,872 | A | 7/1998 | Giret et al. |
| 5,883,062 | A | 3/1999 | Addison et al. |
| 5,906,973 | A | 5/1999 | Ouzounis et al. |
| 5,929,022 | A | 7/1999 | Velazquez |
| 6,017,871 | A | 1/2000 | Baeck et al. |
| 6,018,063 | A | 1/2000 | Isbell |
| 6,048,836 | A | 4/2000 | Romano et al. |
| 6,172,026 | B1 | 1/2001 | Ospinal |
| 6,242,406 | B1 | 6/2001 | Katsuda et al. |
| 6,294,513 | B1 | 9/2001 | Jensen et al. |
| 6,306,812 | B1 | 10/2001 | Perkins et al. |
| 6,326,348 | B1 | 12/2001 | Vinson et al. |
| 6,605,579 | B1 | 8/2003 | Arvanitidou et al. |
| 6,627,592 | B1 | 9/2003 | Shamayeli |
| 6,797,011 | B2 | 9/2004 | Blangiforti |
| 6,878,695 | B2 | 4/2005 | Woo et al. |
| 6,903,064 | B1 | 6/2005 | Kasturi et al. |
| 6,949,498 | B2 | 9/2005 | Murphy et al. |
| 6,953,849 | B2 | 10/2005 | Vali |
| 7,326,675 | B2 | 2/2008 | Schneiderman et al. |
| 7,666,828 | B2 | 2/2010 | Bernhardt et al. |
| 7,879,790 | B2 * | 2/2011 | Bernhardt et al. ..... 510/495 |
| 2002/0039979 | A1 | 4/2002 | Aszman et al. |
| 2002/0187909 | A1 | 12/2002 | Gupta et al. |
| 2004/0071653 | A1 | 4/2004 | Bratescu et al. |
| 2004/0242920 | A1 | 12/2004 | Dado et al. |
| 2005/0215456 | A1 | 9/2005 | Goo et al. |
| 2007/0128129 | A1 | 6/2007 | Stehr |
| 2007/0202069 | A1 | 8/2007 | Tamareselvy |
| 2008/0015135 | A1 | 1/2008 | Debuzzaccarini |
| 2009/0054294 | A1 | 2/2009 | Theiler |

FOREIGN PATENT DOCUMENTS

| | | | |
|---|---|---|---|
| DE | 2247832 | | 4/1973 |
| DE | 3926345 | A1 | 2/1991 |
| EP | 0070077 | | 1/1983 |
| EP | 0075996 | | 4/1983 |
| EP | 0094118 | | 11/1983 |
| EP | 111965 | | 6/1984 |
| EP | 111984 | | 6/1984 |
| EP | 112592 | | 7/1984 |
| EP | 0485500 | A1 | 5/1992 |
| EP | 0 511 091 | A1 | 10/1992 |

(Continued)

OTHER PUBLICATIONS

"Surface Active Agents and Detergents" (vol. I and II by Schwartz, Perry and Berch).

(Continued)

*Primary Examiner* — John Hardee

(74) *Attorney, Agent, or Firm* — McAndrews, Held & Malloy, Ltd.

(57) ABSTRACT

Sulfo-estolides and methods of making them are described. Useful methods include acid side bleaching, partial hydrogenation of the fatty acid, pretreatment of the fatty acid to provide color inhibition, acid side hydrolysis of the sulfo-estolides, or conversion of SHP to an essentially fully hydrolyzed product (HSHP) or a partially hydrolyzed product (PHSHP). Formulations and concentrated formulations of automatic dishwasher detergent or machine wash detergent compositions containing sulfo-estolides, among others, are also included.

28 Claims, No Drawings

FOREIGN PATENT DOCUMENTS

| | | | |
|---|---|---|---|
| GB | 1 047 772 | A | 11/1966 |
| GB | 1082179 | | 9/1967 |
| GB | 1278421 | A1 | 6/1972 |
| GB | 1372034 | | 10/1974 |
| GB | 1 380 390 | A | 1/1975 |
| GB | 2075028 | | 11/1981 |
| GB | 2095275 | | 9/1982 |
| GB | 2247832 | | 3/1992 |
| WO | 88/09367 | | 12/1988 |
| WO | 89/09813 | | 10/1989 |
| WO | WO 90/02116 | A1 | 3/1990 |
| WO | WO 91/02045 | A1 | 2/1991 |
| WO | WO 91/13961 | A1 | 9/1991 |
| WO | 92/05249 | | 4/1992 |
| WO | WO 92/15660 | A1 | 9/1992 |
| WO | 99/05242 | | 2/1999 |
| WO | 00/18363 | A1 | 4/2000 |
| WO | 00/58430 | A1 | 10/2000 |
| WO | 01/53247 | A1 | 7/2001 |
| WO | 2005/113735 | A1 | 12/2005 |
| WO | 2006/062665 | | 6/2006 |
| WO | 2008/137769 | | 11/2008 |
| WO | 2009/094336 | | 7/2009 |

OTHER PUBLICATIONS

Surfactant Science Series, Marcel Dekker, vol. 25 and 48.
Foams Fundamentals and Applications in the Petrochemical Industry, edited by Laurier L. Schraman (1994).
Handbook of Water-Soluble Gums and Resins, Glossary and Chapters 3, 4, 12 and 13, Robert L. Davidson, McGraw-Hill Book Co., New York, NY (1980).
Stein et al., J. Amer. Oil Chemists Soc., 52:323-329 (1975).
Knaggs et al., J. Amer. Oil Chemists Soc., 42(9):805-810 (1965).
Kato et al., J. Surfactants and Detergents, 6(4):331-337 (2003).
Kirk-Othmer, Encyclopedia of Chemical Technology, 5th ed., vol. 23, Wiley-Interscience, Hoboken, NJ (2007), "Sulfonation and Sulfation", pp. 513-562.
McCutcheons' 2009 Functional Materials of North American Edition, vol. 2, pp. 239-246 (2009).
Neiditch et al., J. Amer. Oil Chemists Soc., 57(12):426-429 (1980).
Office Action in U.S. Appl. No. 12/353,751, dated Dec. 1, 2009.
Office Action in U.S. Appl. No. 12/353,751, dated Nov. 17, 2009.
Office Action in U.S. Appl. No. 12/506,977, dated Apr. 16, 2010.
Steinberg, Preservatives for Cosmetics Manual, 2nd Ed., by David S. Steinbens (2006).
Sauls et al., J. Amer. Oil Chemists Soc., 33(9):383-389 (1956).
SDA "Washers and Detergents" publication 2005; http://www.cleaning101.com/laundry/HE.pdf.
Surfactants and Interfacial Phenomena, 3rd ed., by Milton Rosen, published by John Wiley & Sons, Inc., Hoboken, NJ (2004).
Surfactant Science Series, Marcel Dekker, vols. 25 and 48.
European Search Report in EP 09009490.5, dated May 17, 2010.
International Search Report and Written Opinion in PCT/US09/51312, dated Mar. 24, 2010.
International Search Report and Written Opinion in PCT/US10/29654, dated May 25, 2010.
Office Action in U.S. Appl. No. 12/506,861, dated Apr. 21, 2010.
Office Action in U.S. Appl. No. 12/506,861, dated Aug. 19, 2010.
Office Action in U.S. Appl. No. 12/506,977, dated Aug. 18, 2010.
A.J. Stirton, et al.: "Surface-active properties of salts of alpha-sulphonated acids and esters" Journal of the American Oil Chemists' Society, vol. 13, No. 1, Jan. 1954, pp. 13-16, XP002537683 Springer, Berlin, DE ISSN: 0003-021X DOI: 10.1007/BF02544763 The Whole Document.
PCT International Search Report and Written Opinion from International Application No. PCT/US2009/031455 mailed on Aug. 17, 2009.
PCT International Search Report and Written Opinion from International Application No. PCT/US2009/031608 mailed on Oct. 29, 2009.
PCT International Search Report and Written Opinion from International Application No. PCT/US2009/051299 mailed on Oct. 20, 2009.
PCT International Search Report and Written Opinion from International Application No. PCT/US2009/051318 mailed on Oct. 22, 2009.
PCT International Search Report and Written Opinion from International Application No. PCT/US2009/051319 mailed on Oct. 20, 2009.
PCT International Search Report and Written Opinion from International Application No. PCT/US2009/051464 mailed on Oct. 22, 2009.

* cited by examiner

AUTOMATIC OR MACHINE DISHWASHING COMPOSITIONS OF SULFONATED ESTOLIDES AND OTHER DERIVATIVES OF FATTY ACIDS AND USES THEREOF

RELATED APPLICATIONS

This international application claims priority to International PCT application Ser. No. PCT/U.S.09/31608 entitled, "SULFONATED ESTOLIDES AND OTHER DERIVATIVES OF FATTY ACIDS AND USES THEREOF" filed on Jan. 21, 2009, the complete matter of which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present technology, in general, relates to sulfo-estolides. More particularly, the present technology relates to automatic or machine dishwashing compositions of sulfo-estolides derivatives and salts of sulfo-estolides and the various applications and/or processes of utilizing them. Dishwashing detergent compositions suitable for washing dishes, glasses, eating and cooking utensils are extremely difficult to formulate because of the many factors encountered which are not encountered in providing detergent compositions for other uses. Food soil is removed partially by mechanical action of the water jets and partly by physico-chemical action such as wetting, emulsification, adhesion of soiled substrate, alkalinity, oxidation potential, soil suspension and foam control to name a few. Further, compositions must be low-foaming since foam can cause the dishwashing machines not only to overflow but cushions and impedes the mechanical operation of the machine to the extent that performance is measurably decreased. Foam is caused partially by the choice of surfactants used and partially by the accumulation of protein food soils such as egg solids and milk solids that accumulate during the wash cycle that have a tendency to foam. Also, since most dishwashing detergents are composed of inorganic alkaline salts, the fatty food soils become saponified in the hot solution and produce copious foam in the machine, even if the inorganic dishwashing detergent itself does not foam.

Further, recently there exists a challenge for the development of more environmentally friendly or "green" machine dishwashing detergents, as state and federal regulations are restricting the amount and use of phosphates and chlorine in detergents. The desirability of avoiding phosphates in detergents is well recognized, and phosphorus compounds have been banned from laundry detergents for many years, though machine dishwashing detergents have been exempted from phosphate ban on the basis that promote the idea that phosphates are necessary for acceptable washing performance. Phosphorus based compounds, when released into the water sources such as lakes, rivers, and bays, serve as nutrients for plant growth, especially algae growth, resulting in the deterioration of water quality. The algae blooms in lakes and ponds can suffocate plants and animals that live in and around those bodies of water and seriously disrupt the quality of waterways. Further, conventional dishwashing detergent options may also contain chlorine, which the production and use of, ultimately creates toxins which are dangerous for people and the environment. Further, chlorine-based compounds and/or phosphorous-based compounds can be detrimental to the items being washed and lead to wearing and degradation of the dishware items. Therefore, there has been also a challenge in the art for non-foaming green formulations of automatic or machine dishwashing detergents that still provide adequate cleaning capabilities.

BRIEF SUMMARY OF THE INVENTION

In at least one aspect, the present technology provides at least one low-foaming liquid machine dishwashing detergent composition comprising about 0.01% to about 20% by active weight of at least one surfactant of general Formula 1 comprising:

Formula 1

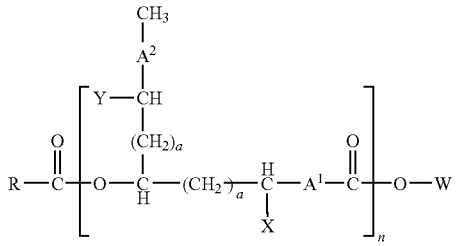

wherein n is an integer from 1-30, or mixtures thereof;

one of X and Y is $SO_3$—Z, the other of X and Y is H (i.e. hydrogen), and X and Y are independently assigned in each repeating unit;

$A^1$ and $A^2$ are linear or branched, saturated or unsaturated, substituted or un-substituted, alkyl diradicals wherein the total number of carbons for each repeating unit is independent and in the range of $C_8$ to $C_{22}$;

a is 0, 1, or 2, and is independently assigned in each repeating unit;

R is linear or branched, saturated or unsaturated, substituted or unsubstituted, wherein the total number of carbon atoms is from 1 to 24;

W is H (i.e., hydrogen) or a monovalent or divalent metal cation, ammonium cation or substituted ammonium cation, or an alkyl or substituted alkyl group;

Z is H (i.e., hydrogen) or a monovalent or divalent metal cation, ammonium or substituted ammonium cation;

from about 0.01% to about 10% by active weight of at least one enzyme; and wherein the low-foaming liquid machine dishwashing detergent composition has a pH from about 9 to about 14.

In another aspect, the present technology provides at least one biodegradable dishwashing detergent composition comprising about 0.01% to about 20% by active weight of at least one surfactant of general Formula 1, comprising:

Formula 1

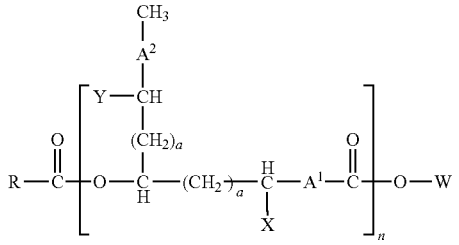

wherein n is an integer from 1-30, or mixtures thereof;

one of X and Y is $SO_3$—Z, the other of X and Y is H, and X and Y are independently assigned in each repeating unit;

$A^1$ and $A^2$ are linear or branched, saturated or unsaturated, substituted or un-substituted, alkyl diradicals wherein the total number of carbons for each repeating unit is independent and in the range of $C_8$ to $C_{22}$;

a is 0, 1, or 2, and is independently assigned in each repeating unit;

R is linear or branched, saturated or unsaturated, substituted or un-substituted, wherein the total number of carbon atoms is from 1 to 24;

W is H or a monovalent or divalent metal cation, ammonium cation or substituted ammonium cation, or an alkyl or substituted alkyl group;

Z is H or a monovalent or divalent metal cation, ammonium or substituted ammonium cation;

from about 0.01% to about 10% by active weight of at least one enzyme; and wherein the low-foaming liquid machine dishwashing detergent composition has a pH from about 9 to about 14, and wherein the composition is substantially free of phosphate.

In a still further aspect, the present technology provides at least one additive which reduces the foaming of a liquid dishwashing detergent by at least 10%, the additive comprising from about 0.01% to about 20% by active weight of at least one surfactant of general Formula 1, comprising:

Formula 1

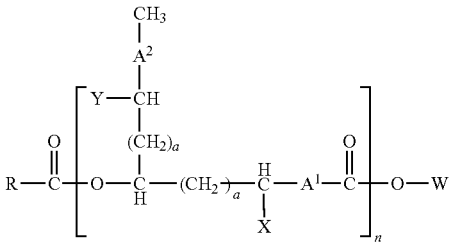

wherein n is an integer from 1-30, or mixtures thereof;

one of X and Y is $SO_3$—Z, the other of X and Y is H, and X and Y are independently assigned in each repeating unit;

$A^1$ and $A^2$ are linear or branched, saturated or unsaturated, substituted or un-substituted, alkyl diradicals wherein the total number of carbons for each repeating unit is independent and in the range of $C_8$ to $C_{22}$;

a is 0, 1, or 2, and is independently assigned in each repeating unit;

R is linear or branched, saturated or unsaturated, substituted or unsubstituted, wherein the total number of carbon atoms is from 1 to 24;

W is H or a monovalent or divalent metal cation, ammonium cation or substituted ammonium cation, or an alkyl or substituted alkyl group; and Z is H or a monovalent or divalent metal cation, ammonium or substituted ammonium cation.

DETAILED DESCRIPTION OF THE INVENTION

The present technology, in general, relates to sulfo-estolides. More particularly, the present technology relates to low-foaming automatic dishwashing compositions of sulfo-estolides derivatives and salts of sulfo-estolides and the various applications and/or processes of utilizing them. Further, the present technology provides eco-friendly and biodegradable dishwashing detergent compositions. These dishwashing detergents include chlorine-free machine dishwashing detergent compositions, phosphate-free machine dishwashing detergent compositions and chlorine-free phosphate-free machine dishwashing detergent compositions. The compositions described here include, but are not limited to, sulfo-estolides having the composition or structure of general Formula 1:

Formula 1

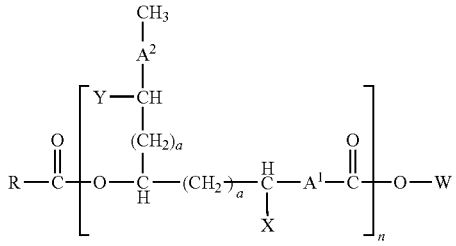

In general Formula 1:

n is an integer from about 1 to about 30, alternatively about 1 to about 10, alternatively 1 to 4, alternatively 1, 2, or 3, alternatively 1 or 2, alternatively 1, or mixtures thereof;

One of X and Y is $SO_3^-Z$, the other of X and Y is H (i.e., hydrogen), and X and Y are independently assigned in each repeating unit;

$A^1$ and $A^2$ are independently selected linear or branched, saturated or unsaturated, substituted or unsubstituted alkyl diradicals, where the total number of carbons for each repeating unit is independent and in the range of $C_8$ to $C_{22}$. As defined here, the term "alkyl diradical" is meant to refer to a linking hydrocarbon or alkylene segment, for example but by no means limited to —$(CH_2)_3$—, —$(CH_2)_4$—, —$(CH_2)_5$—, and so forth;

a is 0, 1, or 2, and is independently assigned in each repeating unit. When a=0, 1, or 2, the functional group corresponds to an alpha-sulfo-estolide, beta-sulfo-estolide, or gamma-sulfo-estolide, respectively;

R can be linear or branched, saturated or unsaturated, substituted or un-substituted hydrocarbon, wherein the total number of carbon atoms can be from about 1 to about 24. In at least one embodiment, R has from about 7 to about 21 carbon atoms, alternatively from about 8 to about 16 carbon atoms, and can be a saturated or unsaturated linear or branched hydrocarbon, a linear or branched hydroxyalkane sulfonate, or a linear or branched alkene sulfonate. For example, in one embodiment, $A^1$ and $A^2$ are linear alkyl diradicals and R is saturated or unsaturated linear hydrocarbon, linear hydroxyalkane sulfonate, or linear alkene sulfonate having from about 7 to about 21, alternatively from about 8 to about 16 carbons;

W is a monovalent or divalent metal; ammonium; substituted ammonium; H (i.e., hydrogen); or a linear or branched, substituted or unsubstituted alkyl having from about 1 to about 22 carbon atoms. For example, W can be an alkali or alkaline earth metal cation. Alternatively, W can be a glycerine joined by an ester linkage, e.g., a substituted C3 alkyl such that the general Formula 1 is incorporated one or more times as an ester in a monoglyceride, a diglyceride, or a triglyceride; and Z is H (i.e., hydrogen) or a monovalent or divalent metal cation, ammonium or substituted ammonium cation, preferably an alkali or alkaline earth metal cation, for example potassium, sodium, calcium, or magnesium, with potassium being preferred in certain embodiments. For example, it has been shown that at least in some embodiments, an automatic dishwasher or machine wash detergent containing a potassium salt is significantly lower in viscosity than a comparable composition that contains the same amount of a sodium salt.

The above structure is illustrative of the sulfo-estolide products that may be derived from, for example, linear unsaturated fatty acid feedstocks. It is understood that sultone hydrolyzed products and structures of a comparable nature may be derived from branched and/or substituted unsaturated fatty acids or mixtures of linear and branched and/or substituted unsaturated fatty acids.

Additional sulfo-estolide compositions may be produced from fatty acid feedstocks comprising polyunsaturated fatty acids, where $A^1$ and $A^2$ may be independently selected from the set of alkyl diradicals that are: a) saturated; b) unsaturated; c) unsaturated and substituted with a sulfonate group; d) substituted with a hydroxyl group and a sulfonate group; or e) substituted with a ester group and a sulfonate group (i.e., a sulfo-estolide).

In another embodiment of the present technology, the sulfo-estolide compositions are comprised of carboxylic esters, or are reported in an ester analysis as carboxylic esters. Although it is contemplated that at least some of these carboxylic esters are sulfo-estolides, the presently described technology is not limited by the accuracy of this belief, for example the compositions may contain carboxylic esters wherein X and Y within one or more repeating units, in general Formula 1, are both H (i.e., hydrogen).

In another embodiment of the present technology, the sulfo-estolide compositions are comprised of sulfo-estolide of general Formula 1 and a non-sulfonated estolide which comprises two or more fatty acid chains that does not contain a sulfonate group.

Definitions

The term "sulfo-estolide" ("SE") is used here to describe general Formula 1. The term "partially hydrolyzed sulfo-estolide" ("PHSE") describes compositions of general Formula 1 wherein the esters have been partially hydrolyzed between (about 1% to about 95%). The term "hydrolyzed sulfo-estolide" ("HSE") describes compositions of general Formula 1 wherein the esters have been fully hydrolyzed (greater than 95%, for example).

The term "sultone hydrolyzed product" ("SHP") is used here to describe salts of sulfo-estolides that are produced from feedstock comprising unsaturated fatty acids by a process comprising the steps of sulfonation with $SO_3$, neutralization, and hydrolysis of sultones. The neutralization and hydrolysis are conducted at a level of caustic addition that maintains the pH in the range from about 4 to about 10.

The resulting product contains carboxylic acid esters at a level that corresponds to about 5 to about 95 mol %, alternatively about 20 mol % to about 60 mol %, alternatively about 20 mol % to about 45 mol %, alternatively about 30 mol % to about 45 mol % of the total carboxylic functionality in the composition. It is contemplated that none or few of the esters (whether they are sulfo-estolides or not) are hydrolyzed in process of making SHP. By processing at a low temperature and neutralizing the acid as it leaves the sulfonator as quickly as possible, it is contemplated that lower ester levels will be obtained. Through optimization of process conditions for production of esters, it is contemplated that products that have higher ester content will be obtained. For example, it is contemplated that the ester content may be obtained at lower and/or higher levels through the selection of the molar ratio of $SO_3$ to alkene functionality used in the sulfonation step, or alternatively or in addition, through the selection of the amount of monounsaturated and/or polyunsaturated fatty acids comprising the unsaturated fatty acid feedstock.

The term "ester hydrolyzed product" ("EHP") is used here to describe a sulfonate composition that is produced from unsaturated fatty acids by sulfonation with $SO_3$ to produce sulfo-estolide and subsequent hydrolysis of greater than about 95% of the carboxylic esters. For example the resulting product may have a carboxylic ester content that corresponds to less than about 5 mol %, alternatively less than about 2 mol %, alternatively less than about 1 mol % of the total carboxylic functionality in the composition.

The term "partially ester hydrolyzed products" ("PEHP") is used here to describe salts of sulfo-estolides that are produced from unsaturated fatty acids by sulfonation with $SO_3$ and hydrolysis of a portion of the carboxylic esters. The molar percentage of hydrolysis of carboxylic esters that is realized is from about 1% to about 95%, alternatively from about 5% to about 90%, alternatively from about 10% to about 90%, alternatively from about 20% to about 90%.

As defined here, the term "free alkalinity" is meant to refer to the total amount of carboxylate anion and hydroxide present in a composition, as may be measured by, for example, potentiometric titration of an aqueous solution with aqueous strong acid, for example HCl, to an endpoint of about pH 3 to about pH 4.5, or alternatively to bromophenol blue endpoint.

As defined here, the term "free caustic" is meant to refer to the total amount of excess strong alkalinity present in a composition, as may be measured by, for example potentiometric titration of an aqueous solution with aqueous strong acid, for example HCl, to an endpoint of about pH 9 to about pH 11.

A "repeating unit" means one instance of the subject matter enclosed by brackets in a formula. For example, if n=15 for a given molecule according to general Formula 1, the molecule has 15 instances of the bracketed structure. Each instance of the bracketed structure can be identical to or different from other instances of the bracketed structure. For example, the Y moiety in general Formula 1 can be H (i.e., hydrogen) in one repeating unit and —$SO_3^-Z$ in another repeating unit of the same molecule.

Making SE or Other Carboxylic Esters

A suitable starting material for the present process is a fatty acid (fatty carboxylic acid). Fatty acids that may be suitable for use in the present technology include but are not limited to linear unsaturated fatty acids of about 8 to about 24 carbons, branched unsaturated fatty acids of about 8 to about 24 carbons, or mixtures thereof. Unsaturated fatty acids provided from commercial sources containing both saturated and unsaturated fatty acids are suitable for use in the present technology. Mixtures of saturated fatty acids and unsaturated fatty acids are also contemplated. In a non-limiting example, fatty acid mixtures that are rich in oleic acid (cis-9-octadecenoic acid) are suitable feedstocks. Other unsaturated fatty acids, for example but not limited to, trans-octadecenoic acids or palmitoleic acid may also be employed in the presently described technology.

Suitable feedstocks may be derived from vegetable and/or animal sources, including but not limited to fatty acids and fatty acid mixtures derived from, for example, canola oil, corn oil, cottonseed oil, linseed oil, olive oil, palm oil, peanut oil, rapeseed oil, safflower oil, sesame oil, soybean oil, sunflower oil, tall oil, tung oil, lard, poultry fat, BFT (bleachable fancy tallow), edible tallow, coconut oil, cuphea oil, yellow grease and combinations of these. Also contemplated are genetically modified or engineered oils that include but are not limited to high oleic sunflower or soybean oil. In some embodiments, the preferred unsaturated fatty acid feedstocks may contain reduced levels of polyunsaturated fatty acids, for example, less than about 15%, alternatively less than about 10%, alternatively less than about 5% on a total weight basis. In some additional embodiments, the fatty acid feedstocks may be obtained by the partial hydrogenation of unsaturated triglycerides, for example soybean oil, followed by hydrolysis of the oil to afford fatty acids that are enriched in monounsaturated fatty acids and depleted in polyunsaturated fatty acids. The above-noted triglycerides optionally hydrogenated, can also be used as feedstocks, alone or in combination with fatty acids. Still further, in some embodiments of the presently described technology, suitable feedstocks may include those that contain appreciable amounts of saturated fatty acids, for example up to about 80%, alternatively about 50%, alternatively about 30%, alternatively about 20% saturated fatty acid by weight. Alternatively, the feedstocks may be enriched in mono unsaturated fatty acids, for example, via distillation; however, undistilled feedstocks are preferred due to lower cost.

In certain embodiments, a chain termination agent can be included in the reaction to reduce or prevent the formulation of products of general Formula 1 in which n is greater than one. The chain termination agent can be, for example, a saturated or unsaturated, substituted or unsubstituted, aliphatic or aromatic carboxylic acid having from about 7 to about 22 carbon atoms, or a combination of any two or more of these. The contemplated characteristic of a chain termination agent preferred for the present purpose is that it can form an ester. One class of preferred chain termination agents is a saturated fatty acid having from about 8 to about 22 carbon atoms, optionally from about 8 to about 14 carbon atoms, optionally about 8, about 10, or about 12 carbon atoms or mixtures of these fatty acid species.

The compounds of general Formula 1 and related compounds (for example, where n=0) can be made, for example, by: a) $SO_3$ sulfonation of a fatty acid, for example oleic acid; b) neutralization with aqueous caustic to afford a sulfonate salt solution with a pH in the range of about 4 to about 10; or c) hydrolysis of the resulting sultones, maintaining the reaction mixture at a pH of about 4 to about 10. Sulfonation can be carried out, for example, using a falling film $SO_3$ process.

Alternatively, the compounds of general Formula 1 and related compounds (for example, where Z=H (i.e., hydrogen) and W=H (i.e., hydrogen)) can be made, for example, by falling film $SO_3$ sulfonation of a fatty acid, for example oleic acid, where the process temperature of the sulfonation is sufficient, for example greater than about 20° C., to result in the formation of carboxylic esters.

Continuous $SO_3$ sulfonation processes, including those that utilizing falling film reactors such as those described in Kirk-Othmer Encyclopedia of Chemical Technology, 5th ed., Vol. 23, Wiley-Interscience, Hoboken, N.J.: 2007, entry entitled "Sulfonation and Sulfation", pp. 513-562, which is hereby incorporated by reference, are suitable for conducting the sulfonation of feedstocks comprising unsaturated fatty acids in accordance with the presently described technology. For example, a monotube concentric reactor, annular film reactor, or multitube film reactor can be used to contact an unsaturated fatty acid feedstock, for example oleic acid, with a gaseous stream of $SO_3$ that is diluted with dry air. The molar ratio of $SO_3$ to alkene functionality in the fatty acid feedstock may be from about 0.3 to about 1.3, alternatively from about 0.5 to about 1.2, alternatively from about 0.8 to about 1.1, alternatively from about 0.9 to about 1.0.

In some embodiments, a preferred ratio, for example, is less than about 0.8 so as to minimize color formation. The fatty acid feedstock is provided to the reactor at a temperature above the melting point of the feedstock, i.e. the feedstock is provided as a liquid. The sulfonation is conducted such that the reaction mass is maintained as a mobile liquid throughout the course of reaction. Preferably, a means of cooling the reaction mixture during the course of contact between the feedstock stream and the gaseous $SO_3$ stream is provided so that the sulfonic acid product is produced from the reactor at a temperature of from about 10° C. to about 80° C., alternatively from about 20° C. to about 60° C., alternatively from about 30° C. to about 60° C.

Sulfonated unsaturated fatty acid salt and sulfonated hydroxy fatty acid salt products include, for example, those sold in Europe as Polystep® OPA by Stepan Company, Northfield, Ill. and as Lankropol OPA and Lankropol OPA-V by Akzo Nobel of Chicago, Ill., and in the United States as Calsoft® OS-45S by Pilot Chemical of Cincinnati, Ohio.

SE is produced from the sulfonation step and comprises carboxylic esters, provided that the reaction conditions are sufficient, for example a high enough temperature of the acid stream, to promote carboxylic ester formation. While not limiting the scope of the presently described technology, the temperature at which carboxylic ester formation may occur is greater than about 10° C., alternatively greater than about 20° C., alternatively greater than about 30° C. The sulfonic acid products may further comprise sulfonic acid esters, including but not limited to cyclic esters, i.e., sultones.

The process of making a sulfo-estolide mixture, including the methods of hydrolyzing sultones, hydrolyzing carboxylic esters and steps of bleaching the sulfono-estolides of the present technology is described in PCT Application Ser. No. PCT/U.S.09/31608, filed Jan. 21, 2009, the complete matter of which is incorporated herein by reference in its entirety.

Product Descriptions

The compositions of the present technology that include general Formula 1, are comprised of complex mixtures of compounds that are monomeric, dimeric, and higher-order oligomeric species in terms of the number of originating fatty acid chains. The oligomerization in these mixtures is via the formation of ester linkages. Branched oligomers are also included.

The sulfo-estolide functional group corresponds structurally to the condensation of the hydroxyl group of an internal hydroxy sulfonate of fatty acid with the carboxylic acid group of a second fatty acid chain, where the second fatty acid chain may be, but is not necessarily limited to: a) an unsaturated or saturated fatty acid; b) an internal hydroxy sulfonate of fatty acid; c) an internal alkene sulfonate or corresponding cyclic anhydride (i.e. sultone) of fatty acid; or d) an internal mono- or poly sulfo-estolide of two or more fatty acids (i.e., trimer, tetramer, etc.). The position of the sulfonate group along the back bone of the fatty acid chains is dictated by the location of the double bond in the starting material (9-octadecenoic acid for example) and the "direction" in which $SO_3$ adds across the double bond (thus, 9- and 10-sulfonate positions from oleic acid).

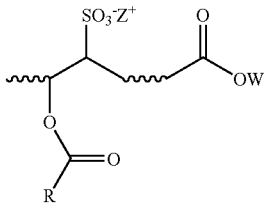

-continued

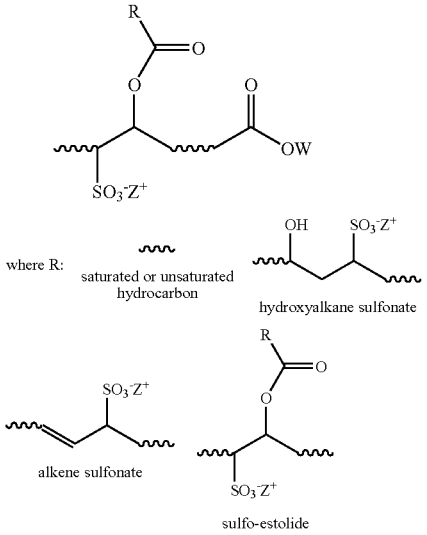

Non-ester-containing monomeric components made by this process are believed to comprise, in part, specific internal hydroxy sulfonates of fatty acid. For example, with 9-octadecenoic acid, the sulfonate groups are believed to be attached to the 9-position and alternatively the 10-position of the fatty acid. Examples are shown below.

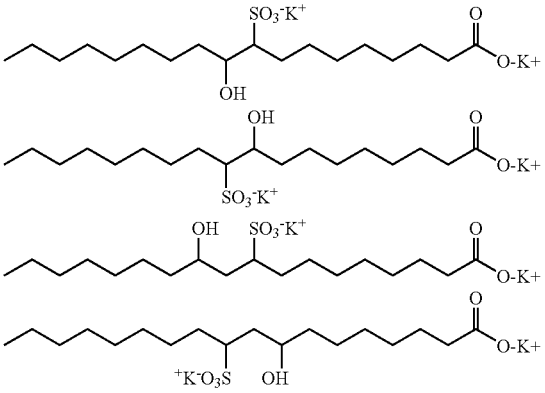

The monomeric components are further believed to comprise, in part, specific internal alkene sulfonates of fatty acid. These components may comprise cis- and/or trans-double bonds. It is also possible that compounds are present where the unsaturation is at the position of the sulfonate group (i.e., vinylic sulfonates). Examples are shown below.

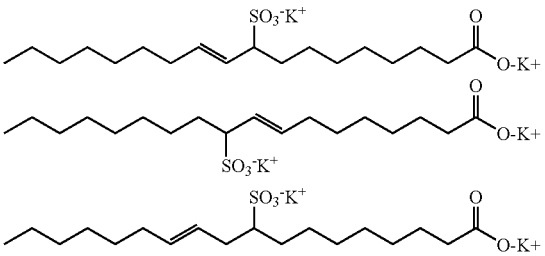

-continued

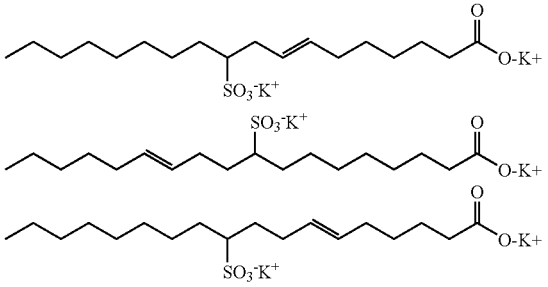

The monomeric components may further comprise disulfonated species, unsaturated fatty acids, and saturated fatty acids.

EHP is sometimes used here as a designation for sulfonated products that have been subjected to complete hydrolysis of sulfo-estolide functionality. Such hydrolysis can be accomplished by, for example, treatment of SHP with excess base under high pH conditions (for example greater than about 11) at elevated temperatures (for example about 85° C. to about 100° C.). EHP is believed to comprise a mixture of hydroxyalkane sulfonates and alkene sulfonates of comparable structure to the monomeric components of sulfo-estolide compositions, though not necessarily in comparable ratios. This mixture is comparable in composition to the compositions of sulfonated unsaturated fatty acids that are described in the art, for example, in T. W. Sauls and W. H. C. Rueggeberg, Journal of the American Oil Chemists Society (JAOCS), Volume 33, Number 9, September, 1956, pp 383-389.

It can be appreciated that PHEP will be comprised of elevated amounts of monomeric hydroxyalkane sulfonates and alkene sulfonates while maintaining some level of sulfo-estolide functionality.

Formulation Applications For SE

The formulations as described in the present technology may be used in formulations including machine and automatic dishwashing detergents. These formulations provide low-foam formulations. Some formulations are phosphate-free, others are chlorine-free and still others are phosphate-free and chlorine-free formulations. Suitably, phosphate-free, chlorine-free formulations comprise enzymes that provide additional cleaning capabilities.

The present technology provides chlorine-free formulations of dishwashing detergents. The incorporation of chlorine bleach requires special processing and storage precautions to protect composition components which are subject to deterioration upon direct contact with the active chlorine. The stability of the chlorine bleach is also critical and raises additional processing and storage difficulties. In addition, it is known that chlorine-containing automatic dishwasher detergent may tarnish silverware and damage metal trim on china. Surprisingly, the formulations of the present technology provide chlorine-free compositions that have cleaning properties as good as or better than the commercial premium household chlorine-containing automatic dishwashing detergents.

These formulations can be used in all of the different delivery processes such as liquids, which can include slurries and gels and the like. These formulations, in some embodiments, are stable with enzymes. In other formulations, some embodiments are stable with peroxide, hypochlorite bleach, and other bleaching agents.

The present technology including compositions of, structures of, or formulations incorporating or used in conjunction or connection with general Formula 1 may also be used to provide anti-foaming properties to a machine or automatic dishwashing detergent composition. The generation of foams, during washing, suppresses the cleaning action of the machine dishwasher. Without effective foam suppression, the mechanical cleaning action of the machine dishwasher is reduced as the result of foam buildup in the aqueous cleaning solution so that the aqueous washing fluid which is normally impelled against the tableware in the machine dishwasher is less effective in cleaning because it is forced against the tableware at reduced pressure. It has been surprisingly found that the sulfo-estolides of general Formula 1 of the present technology provide formulations of machine or automatic dishwashing detergents which have low foaming ability but cleans as well as the household premium brand. This provides formulations that do not need the addition of an added defoaming ingredient, and further lead to compositions requiring fewer ingredients and are thus, less cost to the manufacturer. The standard test for foam production is the Shake Foam test in which 100 mL of a 0.2% actives solution of the test product is inverted multiple times and the total height of foam plus liquid is measured. A product being considered for machine dishwash applications should have less than 1 mL of foam above the original 100 mL, preferably less than 0.1 mL, most preferably zero mL Further, these formulations provide a green eco-friendly formulation which is plant derived and biodegradable but still provides the anti-foaming formulation. A green and eco-friendly formulation can be formulations that are phosphate-free, chlorite-free and/or a combination thereof. These embodiments of compositions of machine dishwashing detergents include surfactants and other ingredients that are, for example, but not limited to, plant derived and found to be non-toxic to the environment.

In some embodiments, the machine or automatic dishwashing detergent includes sulfo-estolide of general Formula 1 at about 0.01% to about 20% based on active weight of the composition. Alternatively, the machine or automatic dishwashing detergent includes about 0.01% to about 15%, alternatively between about 0.01% to about 10%, alternatively between about 0.01% to about 5%, alternatively between about 1% and about 20%, alternatively between about 1% to about 15%, alternatively between about 1% and about 10%, alternatively between about 1% to about 5%, alternatively between about 5% and about 20%, alternatively between about 5% and about 15%, alternatively between about 5% and about 10%, and, and includes any percentage or range there between, including, but not limited to, increments of about 0.1, about 0.2, about 0.3, about 0.4, about 0.5, 0.6, about 0.7, about 0.8, about 0.9 or about 1.0% and multiplied factors thereof (e.g., about 0.5×, about 1.0×, about 2.0×, about 2.5×, about 3.0×, about 4.0×, about 5.0×, about 10×, about 50×, about 100×), for example, but not limited to, about 0.01%, about 0.05%, about 0.1%, about 0.5%, about 0.6%, about 0.8%, about 1.0%, about 2.0%, about 3%, about 4%, about 5%, about 6%, about 7%, about 8%, about 9%, about 10%, about 12%, about 13%, about 15%, about 17%, about 20%, or higher.

In some embodiments, the dishwashing formulations of the present technology include at least one enzyme. The at least one enzymes can be an amylase enzyme or a protease enzyme, or optionally a lipase enzyme or proteolytic enzymes. The at least one amylase enzyme can be an alkaline stable amylase, and the at least one protease enzyme can be an alkaline stable protease. Amylolytic enzymes, or amylases, act to catalyse the hydrolysis of starch. Proteolytic enzymes, or proteases, act to catalyse the hydrolysis of peptide bonds in proteins. Lipolytic enzymes, or lipases, act to catalyse the hydrolysis of fats or oils, which comprise esters of glycerol and fatty acids, into these glycerol and fatty acid components. Protease enzymes include, but are not limited to, subtilisn, bromelin, papain, trypsin, and pepsin, for example EXCELLASE™, PROPERASE®, PURAFECT® OX, PURAFECT® L which can be obtained from Genencor, Rochester N.Y. Amylase enzymes include, but are not limited to, amylase, for example, PURASTAR® OxAm or PURASTAR® HP A, obtainable from Genecor, Rochester N.Y. The at least one enzymes may be a mixture of such enzymes, and suitably may be a mixture of at least one protease and at least one amylase.

Other dishwashing formulations of the present technology may further comprise one or more enzymes, which can enhance cleaning performance. Suitable enzymes for use in the present technology include, but are not limited to enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, beta-glucanases, arabinosidases, derivatives thereof or mixtures thereof.

A preferred combination is a composition having a cocktail of conventional applicable enzymes like protease, amylase, lipase, cutinase and/or cellulase in combination or conjunction with the lipolytic enzyme variant D96L at a level of from about 50 LU to about 8500 LU per liter wash solution.

The cellulases usable in the practice of the present technology include, but are not limited to both bacterial or fungal cellulase. Preferably, they will have a pH optimum of between about 5 and about 9.5. Suitable cellulases are disclosed in U.S. Pat. No. 4,435,307, Barbesgoard et al, which discloses fungal cellulase produced from *Humicola insolens*. Suitable cellulases are also disclosed in GB-A-2 075 028; GB-A-2 095 275 and DE-OS-2 247 832, which are incorporated herein by reference.

Examples of such cellulases are cellulases produced by a strain of *Humicola insolens* (*Humicola grisea* var. *thermoidea*), particularly the *Humicola* strain DSM 1800. Other suitable cellulases are cellulases originated from *Humicola insolens* having a molecular weight of about 50 KDa, an isoelectric point of about 5.5 and containing approximately 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. In particular, they are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991. Cellulases and/or peroxidases can be incorporated in a detergent composition(s) of the present technology at levels from about 0.0001% to about 2% of active enzyme by weight of the detergent composition.

Preferred commercially available protease enzymes include, for example, those sold under the tradenames Alcalase®, Savinase®, Primase®, Durazym®, and Esperase® by Novo Nordisk A/S (Denmark), those sold under the tradename Maxatase®, Maxacal® and Maxapem® by Gist-Brocades (Netherlands), those sold by Genencor International (Rochester N.Y.), and those sold under the tradename Opticlean® and Optimase® by Solvay Enzymes (Brussels, Belgium). Other proteases are described in U.S. Pat. No. 5,679,630, issued Oct. 21, 1997 (P&G), which is incorporated by reference herein, can be included in the detergent composition of the present technology. Protease enzymes may be incorporated into the compositions in accordance with the present technology at a level of from about 0.0001% to about 2% active enzyme by weight of the composition.

A preferred protease for use in practicing the present technology is referred to as "Protease D" and is a carbonyl hydrolase variant having an amino acid sequence not found in nature, which is derived from a precursor carbonyl hydrolase by substituting a different amino acid for the amino acid residue at a position in said carbonyl hydrolase equivalent to position +76, preferably also in combination with one or more amino acid residue positions equivalent to those selected from +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in U.S. Pat. No. 5,679,630, issued Oct. 21, 1997, which is incorporated here by reference in its entirety.

Highly preferred enzymes that can be included in the detergent compositions of the present technology include lipases. It has been unexpectedly found that the cleaning performance on greasy soils is improved (potentially synergistically) by using lipases in one or more formulations of the present technology. Suitable lipase enzymes include, for example, those produced by microorganisms of the *Pseudomonas* group, such as *Pseudomonas stutzeri* ATCC 19.154, as disclosed in British Patent 1,372,034. Suitable lipases include those which exhibit a positive immunological cross-reaction with the antibody of the lipase, produced by the microorganism *Pseudomonas fluorescens* IAM 1057. This lipase is available from Amano Pharmaceutical Co. Ltd., Nagoya, Japan, under the trade name Lipase P "Amano," hereafter referred to as "Amano-P". Further suitable lipases are lipases such as M1 Lipase® and Lipomax® (commercially available from Gist-Brocades). Highly preferred lipases are the D96L lipolytic enzyme variant of the native lipase derived from *Humicola lanuginosa* as described in U.S. Pat. No. 6,017,871 issued Jan. 25, 2000 (P&G). Preferably the *Humicola lanuginosa* strain DSM 4106 is used. This enzyme is incorporated into one or more compositions in accordance with the present technology at a level of from about 50 LU to about 8500 LU per liter wash solution. Also preferably, the variant D96L is present at a level of from about 100 LU to about 7500 LU per liter of wash solution; more preferably at a level of from about 150 LU to about 5000 LU per liter of wash solution.

By D96L lipolytic enzyme variant is meant the lipase variant as described in patent application WO 92/05249 where the native lipase ex *Humicola lanuginosa* aspartic acid (D) residue at position 96 is changed to Leucine (L). According to this nomenclature the substitution of aspartic acid to Leucine in position 96 is shown as: D96L.

Also suitable are cutinases [EC 3.1.1.50] which can be considered as a special kind of lipase, namely lipases which do not require interfacial activation. Addition of cutinases to detergent compositions have been described in e.g., WO-A-88/09367 (commercially available from Genencor), which is incorporated herein by reference. The lipases and/or cutinases are normally incorporated in one or more detergent compositions of the present technology at levels from about 0.0001% to about 2% of active enzyme by weight of the detergent composition.

Amylases (α and/or β) can be included for removal of carbohydrate-based stains. Suitable amylases can be, for example, Termamyl® (commercially available from Novo Nordisk, Denmark), Fungamyl® and BAN® (Novo Nordisk).

The above-mentioned enzymes may be of any suitable origin, such as vegetable, animal, bacterial, fungal and/or yeast origin. See, e.g., U.S. Pat. No. 5,929,022; column 7, 7th paragraph through column 9, 6th paragraph, from which much of the preceding discussion comes. Preferred compositions optionally contain a combination of enzymes or a single enzyme, with the amount of each enzyme commonly ranging from about 0.0001% to about 2% in one or more compositions of the present technology. Other enzymes and materials used with enzymes are described in PCT Publ. WO99/05242, which is incorporated here by reference.

Enzymes are expected to exhibit excellent shelf life in SHP-containing automatic dishwashing and/or machine wash formulations. Not to be bound by any particular theory, it is believed that surfactants with low critical micelle concentration (CMC) values tend to be more mild to enzymes based on low monomer concentrations in solution which interfere with enzyme stability. The measured CMC, via the Wilhelmy plate technique, of SHP is approximately 30 mg/L while that of the sodium salt of AES is approximately 80 mg/L and NaLAS is approximately 900 mg/L.

The at least one enzyme comprises from about 0.01% to about 10% active weight of the present compositions. Alternatively, the at least one enzyme comprises from about 0.01% to about 8%, alternatively from about 0.01% to about 5%, alternatively from about 0.1% to about 10%, alternatively from about 0.1% to about 8%, alternatively from about 0.1% to about 5%, alternatively from about 1% to about 10%, alternatively from about 1% to about 8%, alternatively from about 1% to about 5% by active weight of the compositions, and, and includes any percentage or range there between, including, but not limited to, increments of about 0.1, about 0.2, about 0.3, about 0.4, about 0.5, about 0.6, about 0.7, about 0.8, about 0.9 or about 1.0% and multiplied factors thereof (e.g., about 0.5×, about 1.0×, about 2.0×, about 2.5×, about 3.0×, about 4.0×, about 5.0×, about 10×, about 50×, about 100× or greater). The enzymes are active at the temperature, pH, and dilutions used in standard automatic and machine washing systems.

Enzyme Stabilizing System

The enzyme-containing compositions of the present technology, especially liquid compositions, described herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

In some embodiments, the compositions of the present technology provide an adequate pH range in which the enzymes are active at the desired working temperature and dilutions. Suitable pH ranges for compositions containing at least one enzyme include, but are not limited to, from about pH of about 9 to about 14, more suitably a pH between about 9 to about 11, more suitably between about 10.5 to about 11, and includes any pH range or value there between, including increments of about 0.1, about 0.2, about 0.25, about 0.3, about 0.4, about 0.5, about 0.6, about 0.7, about 0.8, about 0.9, or about 1.0. For formulations containing chlorine, the pH can be from about 10 to about 14, more preferably from about 12 to about 14. The pH range of the compositions can be altered by addition of suitable pH modifiers, including, but not limited to metal silicates, sodium hydroxide, sodium carbonate or the like. Techniques for controlling pH at recommended usage levels include the use of buffers, alkali, acids, etc., and are well known to those skilled in the art.

The compositions of the present technology are stable and active at typical washing operating temperatures of about 40° C. to about 65° C. (about 104° F. to about 150° F.).

Some embodiments of the present technology provide at least one additional surfactant. Surfactants for use in the present technology are low foaming surfactants, and include, but are not limited to, low-foaming nonionic surfactants, short chain anionic surfactants, cationic surfactants, ampholytic surfactants (which can also referred to as amphoteric surfactants), zwitterioinic surfactants, semi-polar surfactants and other low foaming surfactants which are known in the art. Suitable low foaming surfactants are disclosed in PCT Application Serial No. PCT/U.S.09/31608 filed on Jan. 21, 2009, incorporated by reference in its entirety.

Some other low foaming surfactants that are suitable for use in practice with the current technology include, but are not limited to sodium octane sulfonate, polyalkolylated aliphatic base, polyalkoxylated aliphatic base, sodium alphasulfo methyl C12-18 ester combined with disodium alphasulfo C12-18 fatty acid, derivatives thereof, combinations thereof, or others.

Although it is preferred that sulfo-estolide be the only anionic surfactant used in the formulation, other anionic surfactants can be added. "Anionic surfactants" are defined here as amphiphilic molecules with an average molecular weight of less than about 10,000, comprising one or more functional groups that exhibit a net anionic charge when in aqueous solution at the normal wash pH, which can be a pH between about 6 to about 11. The anionic surfactant used in the present technology can be any anionic surfactant that is substantially water soluble. "Water soluble" surfactants are, unless otherwise noted, here defined to include surfactants which are soluble or dispersible to at least the extent of about 0.01% by weight in distilled water at 25° C. It is preferred that at least one of the anionic surfactants used in the present technology be an alkali or alkaline earth metal salt of a natural or synthetic fatty acid containing between about 4 and about 30 carbon atoms. It is especially preferred to use a mixture of carboxylic acid salts with one or more other anionic surfactants. Another important class of anionic compounds is the water soluble salts, particularly the alkali metal salts, of organic sulfur reaction products having in their molecular structure an alkyl radical containing from about 6 to about 24 carbon atoms and a radical selected from the group consisting of sulfonic and sulfuric acid ester radicals. Anionic surfactants useful in the detergent composition include, but are not limited to, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, and the like; and phosphate esters such as alkylphosphate esters, and the like. Exemplary anionic surfactants include sodium alkylarylsulfonate, alpha-olefinsulfonate, and fatty alcohol sulfates as disclosed in PCT Application Serial No. PCT/U.S.09/31608 filed on Jan. 21, 2009, incorporated by reference in its entirety.

Nonionic surfactants useful in the detergent composition include, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol pro-poxylate ethoxylate propoxylates, alcohol ethoxylate butoxylates, and the like; ethoxylated alcohols such as nonylphenol ethoxylate; polyoxyethylene glycol ethers and the like; carboxylic acid esters such as glycerol esters, polyoxyethylene esters, ethoxylated and glycol esters of fatty acids, and the like; carboxylic amides such as dietha-nolamine condensates, monoalkanolamine condensates, polyoxyethylene fatty acid amides, and the like; and polyalkylene oxide block copolymers including an ethylene oxide/propylene oxide block copolymer and the like; and other like nonionic compounds. Silicone surfactants can also be used.

Cationic surfactants that can be used in the detergent composition include, but are not limited to, for example, amines such as primary, secondary and tertiary monoamines with C8 alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl(C12-C18) dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like. The cationic surfactant can be used to provide sanitizing properties. Zwitterionic surfactants that can be used in the detergent composition include, but are not limited to betaines, imidazolines, and propinates.

Mixtures of any two or more individually contemplated surfactants, whether of the same type or different types, are contemplated herein. To make a "green" formula, the surfactants should be ultimately biodegradable and non-toxic. To meet consumer perceptions and reduce the use of petrochemicals, a "green" formula may also advantageously be limited to the use of renewable hydrocarbons, such as vegetable or animal fats and oils, in the manufacture of surfactants.

The at least one additional surfactant in compositions of the present technology are from about 0.01% to about 30% by active weight of the total composition. Alternatively, the at least one additional surfactant comprises about 0.01% to about 15%, alternatively from about 0.01% to about 10%, alternatively from about 0.01% to about 10%, alternatively from about 0.01% to about 5%, alternatively from about 0.1% to about 20%, alternatively from about 0.1% to about 20%, alternatively from about 0.1% to about 15%, alternatively from about 0.1% to about 10%, alternatively from about 0.1% to about 5%, alternatively from about 1% to about 20%, alternatively from about 1% to about 15%, alternatively from about 1% to about 10%, alternatively from about 5% to about 20%, alternatively from about 5% to about 15%, alternatively from about 5% to about 10%, and further including, but not limited to, increments of about 0.1, about 0.2, about 0.3, about 0.4, about 0.5, about 0.6, about 0.7, about 0.8, about 0.9 or about 1.0% and multiplied factors thereof (e.g., about 0.5×, about 1.0×, about 2.0×, about 2.5×, about 3.0×, about 4.0×, about 5.0×, about 10×, about 50×, 100× or higher).

In addition to the surfactants as previously described, a composition commonly contains other ingredients for various purposes. Some of those ingredients are also described below.

In some embodiments, the automatic or machine dishwashing detergent composition includes at least one builder. Preferably, suitable phosphate-free builders known in the art are used. Builders included compositions comprising a mixture of sodium carbonate and/or sodium citrate and low molecular weight polyacrylic polymer, such as a polyacrylate organic and/or inorganic detergent builders, and the like. Other builder salts can be mixed with sodium bicarbonate and/or sodium citrate for example, but not limited to, gluconates, phosphonates and nitriloacetic acid salts.

In some embodiments, the compositions of the present technology provide from about 0.1% to about 40% by weight of at least one builder. Alternatively, the compositions of the present technology include from about 0.1% to about 30%, alternatively from about 0.1% to about 20%, alternatively from about 1% to about 40%, alternatively between 1% and about 30%, alternatively from about 1% to about 20%, alternatively from about 1% to about 10%, alternatively from about 1% to about 10%, alternatively from about 5% to about 40%, alternatively from about 5% to about 30%, alternatively from about 5% to about 20%, alternatively from about 5% to about 10%, and include any percentage or range there between, including, but not limited to, increments of about 0.1, about 0.2, about 0.3, about 0.4, about 0.5, about 0.6, about 0.7, about 0.8, about 0.9 or about 1.0% and multiplied factors thereof (e.g., about 0.5×, about 1.0×, about 2.0×, about 2.5×, about 3.0×, about 4.0×, about 5.0×, about 10×, about 50×, 100×).

The formulations of the present technology may also be included additional components, for example, but not limited to, dispersant polymers (e.g., from BASF Corp. or Rohm & Haas) other than those described above, color speckles, silvercare, anti-tarnish and/or anti-corrosion agents, pigments, dyes, fillers, germicides, hydrotropes, anti-oxidants, enzyme stabilizing agents, pro-perfumes, perfumes, that optionally contain ingredients such as aldehydes, ketones, esters and alcohols, carriers/vehicles/diluents and the like, processing aids, solvents, anti-abrasion agents, thickeners, and other enzyme stabilizing packaging systems. Other additional ingredients that can be included in a composition although not preferred are bleaches and bleach activators, all of which are known to one skilled in the art.

The compositions of the present technology can take any of a number of forms and any of the different delivery systems that are currently known or to be developed in the future such as liquids, gels and the like.

The compositions of the present technology in some embodiments can further comprise at least one thickener. Suitable thickeners are known to one skilled in the art and can include, but are not limited to, xanthan gum, such as Kelzan T (sold by Merk & Co., Whitehouse Station, N.J.). In preferably embodiments, the composition contains a sufficient amount of thickener to thicken the composition to about 100 cps to about 10,000 cps, more preferably about 1000 cps to about 6000 cps as measured at 25° C. using a Brookfield Viscometer model LV, spindle #4 or #5, at a speed of about 20 rpm. Some thickening agents do not work with the present technology, including, methyl cellulose and hydroxylpropyl methyl cellulose. The thickener can comprise about 0.00% (if no thickener is needed) to 5.0%, preferably 0.00% to 2.0%, most preferably 0.00% to 1.00% by weight of the total composition.

In some embodiments, the compositions include an anti-corrosion agent, for example, but not limited to, alkali metal silicates, which function to make the composition anti-corrosive to eating utensils and to automatic dishwashing machine parts. Sodium silicates of $Na_2O:SiO_2$ and potassium silicates can be used, including sodium disilicate and sodium metasilicate. Suitably, in some embodiments, corrosion inhibitors area added for protection of the machine and/or items being washed, for example, reduce corrosion of glass surfaces, tarnishing of silverware and/or discoloration of glazed surfaces, but does not interfere with cleaning and stain removal. Suitable glass corrosion protecting agents include, but are not limited to zinc acetate, salts of calcium, magnesium or mixtures of calcium and magnesium, examples of which can be found in PCT Application No. WO2008137769 to Ecolab, filed on May 2, 2008.

Formulations of the present technology are contemplated having a viscosity of about 5 cPs to about 20,000 cPs, as measured at 25° C. using a Brookfield Viscometer model LV, spindle #4 or #5, at a speed of about 20 rpm to provide a pourable liquid detergent. Alternatively, the formulations of the present technology have a viscosity of from about 100 cps to about 10,000 cps, alternatively from about 100 cps to about 6000 cps, alternatively from about 1000 cps to about 20000 cps, alternatively from about 1000 cps to about 10000 cps, alternatively from about 1000 cps to about 6000 cps, alternatively from about 1000 cps to about 3000 cps, alternatively from about 3000 cps to about 20000 cps, alternatively from about 3000 cps to about 10000 cps, alternatively from about 3000 cps to about 6000 cps, and include any viscosities or range there between, including, but not limited to, increments of about 0.1, about 0.2, about 0.3, about 0.4, about 0.5, about 0.6, about 0.7, about 0.8, about 0.9 or about 1.0 cps and multiplied factors thereof (e.g., about 0.5×, about 1.0×, about 2.0×, about 2.5×, about 3.0×, about 4.0×, about 5.0×, about 10×, about 50×, 100× or higher).

Certain SHP, PEHP, or EHP formulations have been found to have lower viscosity than comparable formulations lacking these surfactants, so these compositions function as viscosity reducers, which is very useful for making the contemplated highly concentrated, (e.g., greater than about 40% surfactant active) detergent formulations.

A wide variety of low-foam dishwashing compositions can be made that include SE, PHSE, HSE, SHP, PEHP, EHP, or combinations of two or more or all of these, as described in the present application, with or without other ingredients as specified below. Formulations are contemplated including about 1% to about 99% SE, PHSE, HSE, SHP, PEHP, and/or EHP, more preferably between about 1% and about 60%, even more preferably between about 1% and about 30%, with about 99% to about 1% water and, optionally, other ingredients as described here.

It will be appreciated by at least those skilled in the art that the terms carrier, vehicle, diluent and the like are to be used interchangeably and non-exhaustively to described the various compounds, compositions, formulations, and applications of the present technology. For example, one carrier suitable for use in the practice of the present technology is water. Others may include, for example, urea, sodium sulfate, among others.

Builders and other alkaline agents are contemplated for use in the present formulations. Any conventional dishwashing builder system is suitable for use here, including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for environmental reasons, phosphate builders could also be used here.

Suitable polycarboxylate builders for use here include citric acid, preferably in the form of a water-soluble salt, and derivatives of succinic acid of the formula:

$$R—CH(COOH)CH_2(COOH)$$

where R is $C_{10-20}$ alkyl or alkenyl, preferably $C_{12-16}$, or where R can be substituted with hydroxyl, sulfo sulfoxyl or sulfone substituents. Specific examples include lauryl succinate, myristyl succinate, palmityl succinate 2-dodecenylsuccinate, or 2-tetradecenyl succinate. Succinate builders are preferably used in the form of their water-soluble salts, including sodium, potassium, ammonium and alkanolammonium salts. Other suitable polycarboxylates are oxodisuccinates and mixtures of tartrate monosuccinic and tartrate disuccinic acid, as described in U.S. Pat. No. 4,663,071.

Especially for a liquid composition, suitable fatty acid builders for use here are saturated or unsaturated $C_{10-18}$ fatty acids, as well as the corresponding soaps. Preferred saturated species have from about 12 to about 16 carbon atoms in the alkyl chain. The preferred unsaturated fatty acid is oleic acid. Another preferred builder system for liquid compositions is based on dodecenyl succinic acid and citric acid.

General Considerations for Cleaning Products

Desirable attributes of the present technology include being in liquid form at room temperature, an ability to formulate in cold-mix applications, an ability to perform as good as or better than existing dishwashing formulations. In some embodiments, the dishwashing compositions of the present invention provide a chlorine-free phosphate-free formulation which is eco-friendly ("green") and biodegradable which has the ability to perform as good as or better than existing phosphate-containing and/or chloride-containing dishwashing detergents.

For automatic dishwashing detergents, it is important to have ingredients that do not provide excess foam and help to loosen the food product debris on the items to be washed. Desirable attributes for such products include the ability to emulsify, suspend or penetrate greasy or oily soils and suspend or disperse particulates, in order to clean surfaces; and then prevent the soils, grease, or particulates from re-depositing on the newly cleaned surfaces.

The presently described technology and its advantages will be better understood by reference to the following examples. These examples are provided to describe specific embodiments of the present technology. By providing these specific examples, it is not intended to limit the scope and spirit of the present technology. It will be understood by those skilled in the art that the full scope of the presently described technology encompasses the subject matter defined by the claims appending this specification, and any alterations, modifications, or equivalents of those claims.

EXAMPLES

The compositions and processes described here, and ways to make and use them are illustrated by the following examples. Examples stated in the present or future tense are not represented as having been carried out. Examples to the methods of producing and testing sulfo-estolides of the present technology are incorporated by reference in their entirety from PCT Application Serial No. PCT/U.S.09/31608 filed on Jan. 21, 2009, Examples 1-26.

Example 1

Preparation of a Bleached Aqueous Concentrate of a Sulfonated Estolide (SE)

The feedstock used in this example had an equivalent weight of about 275.06 and was comprised of about 78% C-18:1, about 12% C-18:2, and about 9% saturated fatty acids. The feedstock was sulfonated on a falling film reactor at a rate of about 129.3 lbs per hour using a molar ratio of $SO_3$ to alkene functionality of about 0.95. The SE sulfonic acid was continuously neutralized in a loop reactor with concurrent addition of about 49.1 lbs per hour of 45% aqueous KOH and about 37.9 lbs per hour of water. The temperature of the reaction mixture in the loop reactor was about 80° C. Neutralized SE solution was continuously fed from the loop reactor to an in-line mixer, where about 2.61 lbs per hour of 50% aqueous hydrogen peroxide was homogenized into the solution, which was about pH 5.8. This reaction mixture was then fed to a stirred tank reactor. After collecting about 60 gallons of reaction mixture, concurrent sultone hydrolysis and bleaching were continued at about 80° C. for about 4 additional hours. At the end of this 4 hour hydrolysis and bleaching period about 16.5 lbs of 38% sodium bisulfite solution was added to the reaction mixture to reduce the residual peroxide in solution from about 0.25% (wt/wt) active peroxide down to about 0.02% (wt/wt) active peroxide. The SE produced from this reaction was at a pH of about 5.0, was comprised of about 69.8% solids and about 0.017% (wt/wt) active peroxide, and had a Klett color at 1 percent solids concentration of 51. Utilizing the titration method described in Example 2 the carboxylic ester was determined to be about 40.8 mol percent.

Example 2

Ester Hydrolysis of SE to Produce HSE

To a quart (1-liter) jar was added about 528 grams (g) of the SE of Example 1, and about 107.03 g of 45 wt. % aqueous KOH, which corresponded to a molar amount of KOH necessary to: (a) neutralized all free carboxylic acids in the SE; and (b) to hydrolyzed the carboxylic esters in the SE with 1.05 molar equivalents of free caustic. To this was also added about 144.15 grams (g) of water and the contents were thoroughly mixed and then the jar was sealed and placed in an approximately 85° C. oven for about 18 hours. Upon cooling, the obtained HSE was homogeneous, free of precipitation or solids, and was a highly flowable liquid. The HSE was analyzed by titration with aqueous HCl and was found to comprise about 1.66 meq/g of potassium carboxylate. Based on the mass balance from the reagent charges for the ester hydrolysis reaction and the change in carboxylate content, the degree of ester hydrolysis was calculated to be about 98.2 mol percent. At this level of ester hydrolysis, the carboxylic ester content in the HSE was calculated to about 0.7 mol percent of total carboxylic functionality in the HSE.

Example 3

Comparison of Surface Activites

The surface activities of SE (details of SE production are provided in Example 1) were compared with other commonly used anionic surfactants, STEOL® CS-230 (Sodium Laureth Sulfate, 2EO), STEOL® CS-330 (Sodium Laureth Sulfate, 3EO), STEPANOL® WA-EXTRA (Sodium Lauryl Sulfate), all available from Stepan Company, Northfield, Ill. The surface activity was measured using Kruss K12 tensiometer at 25° C. in DI water. The results can be found in Table 1. The critical micelle concentration (CMC) and the surface tension at CMC are important properties for a surfactant. CMC indicates the minimum concentration of a surfactant that forms aggregates. The surfactant with lower CMC is more effective to emulsify or remove oil. The surface tension indicates how efficient a surfactant can reduce the surface energy of water. Lower surface tension is favorable for wetting and cleansing. The results showed that SE is an effective surfactant.

TABLE 1

| | CMC (mg/L) | Surface Tension @CMC (mN/m) |
|---|---|---|
| SE | 36.1 | 34.5 |
| STEPANOL WA-EXTRA (SLS) | 184.8 | 26.3 |
| STEOL CS-230 (SLES-2) | 171 | 25 |
| STEOL CS-330 (SLES-3) | 75 | 30 |

Example 4

Phosphate-free Chlorine-free Automatic Dishwashing Detergent

Table 2 present formulation of the present technology that contains the sulfo-estolides of the present technology in a phosphate-free, chlorine-free formulation.

Phosphate Free, Sodium Hypochlorite Free, Enzyme Based Formula, Low pH

TABLE 2

| Component | (%) actives in ADW | (%) wt as is | Function | Order of addition |
|---|---|---|---|---|
| Dl Water | 0.00 | 46.35 | vehicle/carrier | 1 |
| HSE | 5.00 | 10.00 | anionic surfactant | 5 |
| Sodium silicate | 12.00 | 12.00 | degreaser, anti-corrosion | 3 |
| Sodium citrate dihydrate | 15.00 | 15.00 | buffer, chelating | 2 |
| Properase 1600L | 2.00 | 2.00 | protease | 7 |
| Purastar ST 15000L | 2.00 | 2.00 | amylase | 8 |
| Hydrochloric acid (37.5%) | | 12.15 | pH adjustment | 4 |
| Kelzan T | 0.50 | 0.50 | thickener | 6 |
| Total | | 100.00 | | |

The procedure for making the formulations described above were made by the following procedure:

Add Sodium citrate to DI water and mix until it dissolves.

Add Sodium silicate and mix thoroughly to get an even solution with no precipitates.

Drop the pH (as is) to 10 with hydrochloric acid (37.5%)

Add HSE and mix well.

Add Kelzan T and mix well along with heating the solution to 40° C. Mix well to get the thickener completely into the solution without any lumps.

Add the enzymes and mix well.

The viscosity of the formulation was measured using a Brookfield model LV, S63 at a speed of approximately 50 rpm at 25° C. The formulation had a viscosity of 3200 cps. The final pH of the formulation was 10.32 and had a light yellow, opaque thick liquid appearance at 25° C. Production details for the HSE used in this Example are provided in Examples 1 and 2. The enzyme used in the formulations was a combination of Properase 1600L and Purastar ST 15000L which are available from Genencor, Rochester N.Y. This formulation is stable at 50° C. for at least one week, with no separation seen The formulation was tested for its performance using a modified version of the Standard Method for "Deposition on Glassware During Mechanical Dishwashing" designated as ASTM-D3556-85. This test method covers a procedure for measuring performance of a mechanical dishwashing detergent in terms of the buildup of spots and film on glassware. It is designed to evaluate household automatic dishwasher detergents but also be used as a screening test for institutional dishwashing products. The method is modified in that the food-stuff was left to sit on the dishware overnight before the test was run. Briefly, 30.0 plus/minus 0.1 grams are used in a standard pots/pans cycle with 7 plates soiled with 5.7 grams each of shell soil in the bottom rack (40 grams total), and tumblers/silverware on the top rack for grading. The machine is loaded as follows: In the lower (plate) rack, the six soiled dinner plates are distributed uniformly with the smaller plates and bowls, if used, placed alternately about the dinner plates until the rack is fully loaded. In the upper (glass) rack, the glass tumblers are distributed evenly. In the silverware rack or holder, six each of the stainless steel knives, forks, and spoons are placed. Washing is done using a dishwasher with a water temperature of at least 130 6 5° F. (54.4 6 3.8° C.) in the dishwasher. The machine is preheated by running a preliminary cycle with the machine empty. The contents of the machine are allowed to cool to about 75° F. (23.9° C.) before making evaluations or starting another wash cycle. Three cycles of wash were performed, with the food soil reapplied after each one. The dishes are rated after each cycle. The tumblers are rated visually after each cycle for film and spotting. For these evaluations, the tumblers are viewed upside down in the light box described in 4.4 (in handling, pick up the tumblers by the base to avoid fingerprints on the sides). The following scale is used for rating the tumblers:

Rating Spotting Filming

1: no spots

2: spots at random barely perceptible

3: about ¼ of surface covered slight

4: about ½ of surface covered moderate

5: virtually completely covered heavy

Number ratings are obtained by averaging the ratings for individual tumblers, keeping spotting and filming results separate.

The results of these runs can be found in Table 5.

TABLE 5

| Sample | Spotting | Filming | Rating |
|---|---|---|---|
| Run-1 | | | |
| HSE, no phosphates, no NaOCl 2% enzyme, low pH | no spots | none | 0 |
| Run-2 | | | |
| HSE, no phosphates, no NaOCl 2% enzyme, low pH | no spots | none | 0 |
| Run-3 | | | |
| HSE, no phosphates, no NaOCl 2% enzyme, low pH | no spots | none | 0 |
| Cascade after 3 runs | no spots | none | 0 |

The results show that formulations of the present technology clean as well as an industrial standard Cascade Complete®, available from Proctor and Gamble, Cincinnati, Ohio. Therefore, there is a substantially free of phosphates and chlorine formulation of dishwashing detergent that cleans as well as the industrial standard containing phosphates and chlorine.

Example 5

Prophetic Automatic Dishwasher Detergent Formulations

The following prophetic formulas, in Table 6, are intended to illustrate various automatic dishwasher detergent (ADW) formulations of the present technology. These formulations are not intended to be limiting in any way—optional ingredients described herein regarding the present technology can be added in the proportions described.

TABLE 6

| Component | (%) actives in ADW | (%) wt as is |
|---|---|---|
| DI Water | | up to 100 |
| HSE | 0.01-70 | 0.01-95 |
| Anionic/nonionic surfactant | 2-15 | 3-50 |
| Anti-corrosion | 1-15 | 1-15 |
| Buffer, chelating | 1-30 | 1-20 |
| Protease | 0.1-5.0 | 1-5 |
| Amylase | 0.1-5.0 | 1-5 |
| Lipase | 0.1-5.0 | 1-5 |
| Enzyme stabilizer | 0.001-7 | 0.001-7 |
| Thickener | 0.0-5.0 | 0.1-5 |

The embodiments and examples described here are illustrative, and do not limit the presently described technology in any way. The scope of the present technology described in this specification is the full scope defined or implied by the claims. Additionally, any references noted in the detailed description section of the instant application are hereby incorporated by reference in their entireties, unless otherwise noted.

What is claimed is:

1. A low-foaming liquid machine dishwashing detergent composition comprising:

from about 0.01% to about 20% by active weight of at least one surfactant of general Formula 1 comprising:

Formula 1

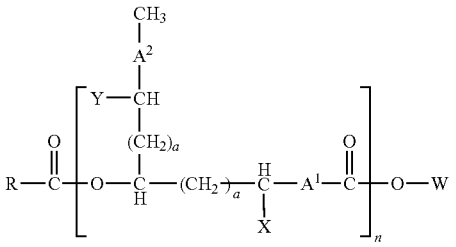

wherein n is an integer from 1-30, or mixtures thereof;

one of X and Y is $SO_3$—Z, the other of X and Y is H (i.e. hydrogen), and X and Y are independently assigned in each repeating unit;

$A^1$ and $A^2$ are linear or branched, saturated or unsaturated, substituted or un-substituted, alkyl diradicals wherein the total number of carbons for each repeating unit is independent and in the range of $C_8$ to $C_{22}$;

a is 0, 1, or 2, and is independently assigned in each repeating unit;

R is linear or branched, saturated or unsaturated, substituted or unsubstituted, wherein the total number of carbon atoms is from 1 to 24;

W is H (i.e., hydrogen) or a monovalent or divalent metal cation, ammonium cation or substituted ammonium cation, or an alkyl or substituted alkyl group;

Z is H (i.e., hydrogen) or a monovalent or divalent metal cation, ammonium or substituted ammonium cation; and from about 0.01% to about 10% by active weight of at least one enzyme;

at least one corrosion protecting agent; and wherein the low-foaming liquid machine dishwashing detergent composition has a pH from about 9 to about 14.

2. The low-foaming composition of claim 1, wherein the composition comprises about 1% to about 10% by active weight of compounds of Formula 1.

3. The low-foaming composition of claim 1, wherein the composition comprises about 5% to about 10% by active weight of compounds of Formula 1.

4. The low foaming composition of claim 1, wherein the pH is from about 9 to about 11.

5. The low foaming composition of claim 1, wherein the pH is from about 10.5 to about 11.

6. The low foaming composition of claim 1, wherein the at least one enzyme is about 1% to about 5% by active weight of the composition.

7. The low foaming composition of claim 1, wherein the at least one enzyme comprises at least one amylase.

8. The low foaming composition of claim 7, wherein the at least one amylase comprises at least one alkaline stable amylase.

9. The low foaming composition of claim 8, wherein the at least one enzyme comprises at least one protease.

10. The low foaming composition of claim 9, wherein the at least one protease comprises at least one alkaline stable protease.

11. The low foaming composition of claim 9, further comprising at least one thickener, wherein the viscosity of the composition is from about 1000 cps to about 6000 cps as measured by a Brookfield Viscometer Model S63 set at a speed of 50 rpm at a temperature of 25° C.

12. The low foaming composition of claim 11, wherein the composition further comprises at least one additional low-foaming surfactant.

13. The low foaming composition of claim 12, wherein the at least one low-foaming surfactant is a member selected from the group consisting of sodium octane sulfonate, polyalkolylated aliphatic base, polyalkoxylated aliphatic base, sodium alphasulfo methyl C12-18 ester combined with disodium alphasulfo C12-18 fatty acid, derivatives thereof, or combinations thereof.

14. The low foaming composition of claim 12, wherein the composition further comprises at least one additional low-foaming surfactant.

15. The low foaming composition of claim 14, wherein the composition further comprises at least one builder.

16. The low foaming composition of claim 14, wherein the builder comprises about 0.1% to about 40% by weight of the composition.

17. The low foaming composition claim 14, wherein the composition is a gel or a liquid.

18. The low foaming composition of claim 14, further comprising at least one additive.

19. The low foaming composition of claim 18, wherein the at least one additive is a selected from the group consisting of silvercare, anti-tarnish, pigments, dyes, fillers, germicides, hydrotropes, anti-oxidants, enzyme stabilizing agents, pro-perfumes, perfumes, aldehydes, ketones, esters and alcohols, carriers, processing aids, solvents, anti-abrasion agents, thickeners, enzyme stabilizing packaging systems, and combinations thereof.

20. The low foaming composition of claim 12, wherein the at least one additional surfactant comprises about 5% to about 30% by weight of the composition.

21. The low foaming composition of claim 1, wherein the corrosion protecting agent is a metal silicate.

22. The low foaming composition of claim 1, wherein the corrosion protecting agent comprises from about 5% to about 20% by weight of the composition.

23. A biodegradable dishwashing detergent composition comprising:

from about 0.01% to about 20% by active weight of at least one surfactant of general Formula 1, comprising:

Formula 1

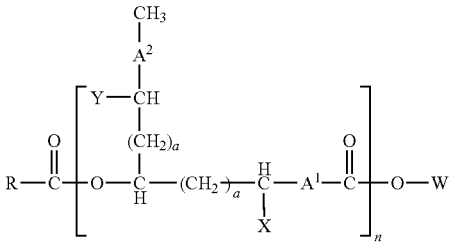

wherein n is an integer from 1-30, or mixtures thereof;

one of X and Y is $SO_3$—Z, the other of X and Y is H, and X and Y are independently assigned in each repeating unit;

$A^1$ and $A^2$ are linear or branched, saturated or unsaturated, substituted or un-substituted, alkyl diradicals wherein the total number of carbons for each repeating unit is independent and in the range of $C_8$ to $C_{22}$;

a is 0, 1, or 2, and is independently assigned in each repeating unit;

R is linear or branched, saturated or unsaturated, substituted or un-substituted, wherein the total number of carbon atoms is from 1 to 24;

W is H or a monovalent or divalent metal cation, ammonium cation or substituted ammonium cation, or an alkyl or substituted alkyl group;

Z is H or a monovalent or divalent metal cation, ammonium or substituted ammonium cation; and from about 0.01% to about 10% by active weight of at least one enzyme;

at least one corrosion protecting agent; and wherein the low-foaming liquid machine dishwashing detergent composition has a pH from about 9 to about 14, and wherein the composition is substantially free of phosphate.

24. The biodegradable dishwashing detergent composition of claim 23, wherein the composition is substantially free of phosphate and substantially free of hypochlorite.

25. The biodegradable dishwashing detergent composition of claim 23, wherein the composition comprises about 1% to about 20% by active weight of compounds of Formula 1.

26. The biodegradable dishwashing detergent composition of claim 23, wherein the composition comprises about 5% to about 10% by active weight of compounds of Formula 1.

27. The biodegradable dishwashing detergent composition of claim 23, wherein the corrosion protecting agent is a metal silicate.

28. The biodegradable dishwashing detergent composition of claim 23, wherein the corrosion protecting agent comprises from about 5% to about 20% by weight of the composition.

* * * * *